US005999078A

United States Patent [19]

Herbert

[11] Patent Number: 5,999,078

[45] Date of Patent: Dec. 7, 1999

[54] TRANSFORMER AND RECTIFIER MODULE WITH HALF-TURN SECONDARY WINDINGS

[76] Inventor: Edward Herbert, 1 Dyer Cemetery Rd., Canton, Conn. 06019-2029

[21] Appl. No.: 09/093,543

[22] Filed: Jun. 8, 1998

Related U.S. Application Data

[60] Provisional application No. 60/048,995, Jun. 9, 1997.

[51] Int. Cl.[6] ..... H01F 17/04; H01F 27/28

[52] U.S. Cl. ..... 336/172; 336/183

[58] Field of Search ..... 336/172–175, 336/183, 223, 192, 195; 323/355, 362

[56] References Cited

U.S. PATENT DOCUMENTS

| | | | |
|---|---|---|---|
| 3,768,055 | 10/1973 | Oliver | 336/73 |
| 4,159,457 | 6/1979 | Charpentier | 336/183 |
| 4,945,319 | 7/1990 | Wilson | 336/192 |
| 5,479,146 | 12/1995 | Herbert | 336/61 |

*Primary Examiner*—Matthew Nguyen

[57] ABSTRACT

A transform-rectifier module has a one-half turn secondary winding installed with very short, direct connections to four rectifiers. The core of the transformer has two parallel through holes. The secondary winding comprises two "Y" shaped windings. The "Y" legs of each winding are installed through the through holes from opposite sides of the core, and the ends of the "Y" windings connect to the four rectifiers. The common connections of the "Y" windings terminate on a ground plane. The rectifiers may be mounted on a common power plane which may also be a heat sink for the rectifiers and a mounting plate for the module as a whole. There is room through the through holes for a primary winding, which may be installed during manufacture or later. The modules may be used singly or in a matrix transformer-like arrangement. They are characterized by very low leakage inductance, high current capacity, good thermal properties and a low profile.

7 Claims, 3 Drawing Sheets

TRANSFORMER AND RECTIFIER MODULE WITH HALF-TURN SECONDARY WINDINGS

This application is a Continuation in Part of a application Ser. No. 60/048,995 filed Jun. 9, 1997, entitled FRACTIONAL TURN MATRIX TRANSFORMER MODULE. Priority is claimed to that date.

BACKGROUND OF THE INVENTION

This invention relates to high frequency transformer and rectifier circuits, particularly transformer and rectifier circuits for switched mode power supplies and the like. The module may be used in a matrix transformer array as any other matrix transformer module, except that it will have a secondary turns of one-half turn. For more information about matrix transformers, please refer to U.S. Pat. Nos. 4,665,357; 4,845,606; 4,942,353; 4,978,906; 5,093,646; and 5,479,146, the specifications and drawings of which are incorporated herein by reference.

"High frequency" may be hundreds of kilohertz, or even megahertz, but in very large transformers "high frequency" design techniques are advantageous even at commercial line frequency. Whenever parasitic reactive impedances are important, or the conductor dimensions are greater than the penetration depth, the teachings of this invention are applicable.

In high frequency power transformers, it is particularly important to reduce leakage inductance. This invention teaches several features which cooperate to accomplish that objective. First, the arrangement of the winding terminations are such that much of the leakage inductance in the external circuits proximate to the transformer is canceled. Second, the external circuits proximate to the transformer are arranged for low leakage inductance. Third, by using a half-turn arrangement, the number of primary turns needed is reduced by half. Since the primary leakage inductance is proportional to the square of the turns in the primary, the primary leakage inductance is reduced.

Additional benefits are that the design is inherently low profile, the thermal paths are very short and spread out, the component parts are inexpensive and very rugged.

BRIEF DESCRIPTION OF THE DRAWINGS

FIG. 1 shows a transformer having a half-turn secondary winding with four rectifiers, and a four turn primary winding, for an overall effective turns ratio of 8 to 1.

FIG. 2 shows the magnetic cores and secondary winding and circuit for the transformer of FIG. 1.

FIG. 3 shows the magnetic cores and one half of the secondary winding of the transformer of FIG. 1.

FIG. 4 shows the magnetic cores and the four turn primary winding of the transformer of FIG. 1.

Figure 1:
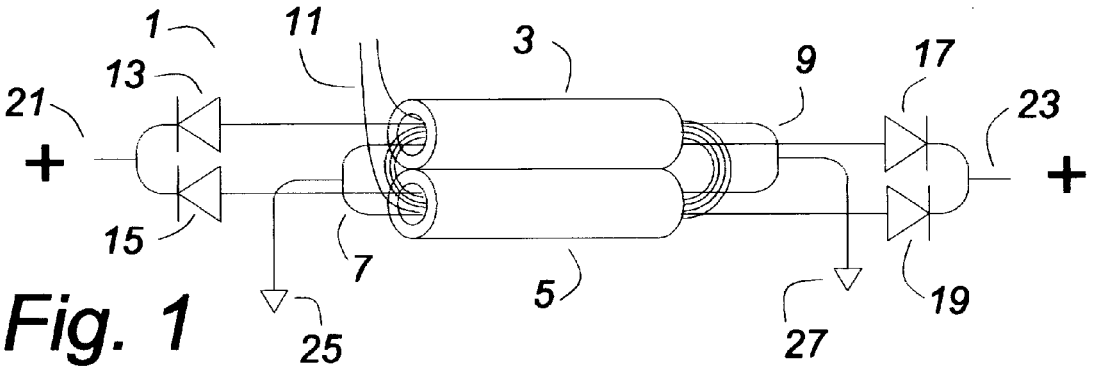
FIGS. 1 through 4 are diagrammatic.

DESCRIPTION OF THE PREFERRED EMBODIMENT OF THE INVENTION:

FIG. 1 shows transformer and rectifier module 1 having a half turn secondary winding. The transformer module 1 comprises two magnetic cores 3 and 5, which are preferably long, slender, gap-less tubular cores of a magnetic material such as manganese-zinc ferrite. If more convenient, the magnetic cores 3 and 5 may be of different geometry, for example, not as a limitation, a two holed balun style core or a long, slender E—E or E–I core. The cores may comprise a number of smaller cores or toroids stacked. Although not essential, it is preferred to use gap-less cores, for higher inductance, reduced leakage inductance and parametric consistency.

Figure 2:
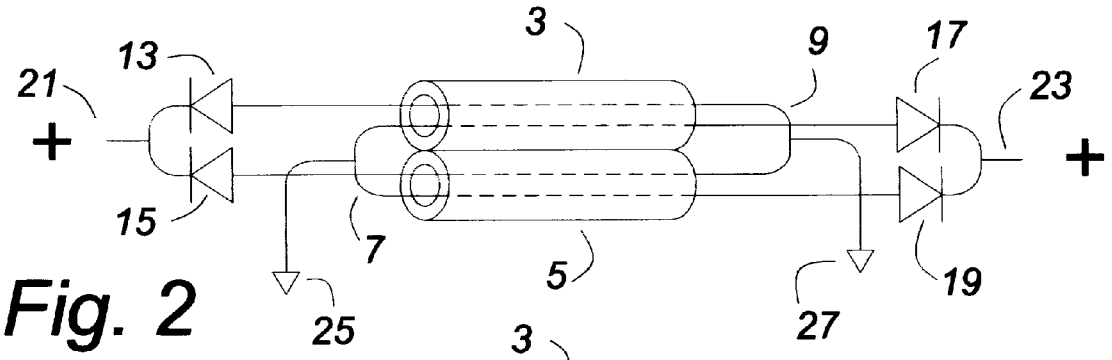
Figure 3:
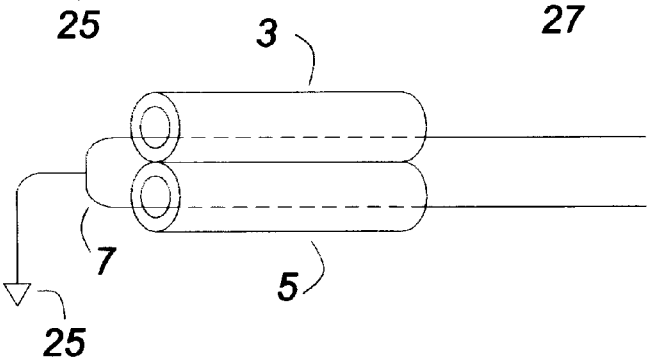

FIG. 2 shows the transformer and rectifier module of FIG. 1 without the primary winding 11, for clarity. FIG. 3 shows one half of the secondary winding 7 alone, for clarity.

In FIGS. 2 and 3, it can be seen that the secondary windings 7 and 9 comprise a pair of identical "Y" shaped windings 7 and 9 threaded through the magnetic cores 3 and 5, one from each end. As an example, not a limitation, the centers of the "Y" windings are grounds 25 and 27. Although shown fairly open in exaggerated scale, it is preferred that this connection to ground be very, very short, and preferably wide and thin, as a strap. It is contemplated that the ground connections 25 and 27 would be to a ground plane, for high current capacity and minimal inductance.

The open ends of the "Y" windings 7 and 9 are taken respectively to rectifiers 13, 15, 17 and 19. The cathodes of the rectifiers 13, 15, 17 and 19 are connected to positive outputs 21 and 23, which are common. It is contemplated that the power output connections 21 and 23 would be a power plane, for high current capacity and minimal inductance.

Figure 4:
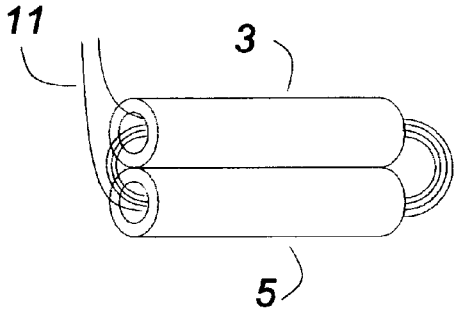

FIGS. 1 and 4 shows that the primary winding 11 is threaded through the magnetic cores 3 and 5, down through one, back through the other, and so forth until there are the required number of primary turns. In the example of FIGS. 1 and 4, there are four primary turns. Because the secondary is a half turn winging, the overall ratio of the transformer is four to one-half, or eight to one.

The ratio of the transformer can be understood by studying either the current or the voltage relationships. They necessarily must give the same result. Let us examine the relationship of the current in the primary winding 11 to the currents in the secondary windings 7 and 9.

Assume that there is an AC excitation for the primary winding 11, such as would be produced, as an example, not a limitation, by the familiar half bridge or full bridge primary switch arrangements. This and other suitable primary drive circuits would be familiar to one skilled in the art of power converters. The AC excitation could be from any suitable source, including commercial AC current. Not being at the point of novelty, the switching circuits or other sources of AC excitation are not shown.

During a given half cycle of the AC excitation, current will flow in one direction through the primary winding 11. As an example, not a limitation, let us assume that the primary current is one ampere. It is well known that the sum of the ampere-turns in a transformer equals zero (ideally, neglecting magnetization currents). Therefore, the sum of the secondary currents must be four amps in each of the magnetic cores 3 and 5.

The "Y" shaped secondary windings 7 and 9 are connected to the anodes of four rectifiers 13, 15, 17 and 19. As is well known, rectifiers permit current flow in one direction only. With respect to the current flow in the primary, the legs of the secondary "Y" winding have opposite phasing, so only one leg of the "Y" can conduct current. For example, if the current in the primary 11 is flowing clockwise, the currents in the secondaries must flow anti-clockwise, and it must be four amperes, given the example of a one ampere primary current. Thus, for example, four amperes will flow from ground 25 through one leg of the "Y" secondary winding 7 to the rectifier 19 and thence out through the power output 23. Similarly, a four ampere current must flow from ground 27 through one leg of the "Y" secondary winding 9 to the rectifier 13 and thence out through the power output 21. The power outputs 21 and 23 are common, so the total output is 8 amperes, eight times the primary current. Thus the transformer ratio is eight to one. But there are only four primary turns, so the secondary is effectively a half turn.

In the above example, the rectifiers are shown, for illustration, not a limitation, as two terminal component rectifiers. Any switching means having suitable timing may be substituted for the component rectifiers, such as synchronous rectifiers which may be, as an example, not a limitation, MOSFET switches. Transformers are inherently reversible. By substituting switching means with correct timing for rectifiers, the half turn secondary can become a half turn primary in a step up transformer. "Secondary" is used as a convenience, but in the specification and the claims, "Secondary winding" and like phrases is used generically for the higher current winding regardless of the direction of power flow. In some applications, the "secondary winding" may be a primary winding, and vice versa. Although a single primary winding is shown in FIGS. 1 and 4, as an example, not a limitation, the teachings of this invention are equally applicable if other winding arrangements are used, for example, not a limitation, push pull (center-tapped) windings or split windings.

In applying the teachings of this invention, it must be understood that the FIGS. 1 through 4 are diagrammatic. While functional if laid out as shown, they are not optimum. In particular, the wire lengths are much to long and open. It is well known that opposite and equal currents in conductors that are close to each other will tend to cancel the far magnetic field and reduce the leakage inductance of the wires. Such equal and opposite currents exist in the secondary, in that, at each end, the current in the ground lead is equaled by the current to one of the adjacent rectifiers and the power output lead. Fractional turn windings are notoriously high in leakage inductance. However, by keeping proximate currents in balance, this invention teaches a half turn winding with very low leakage inductance. It is preferred that the windings terminate in the very shortest distance to a ground or power plane. If they cannot, it is preferred that they be bundled and routed so that counter-flowing currents are together.

This, and the other examples in this specification and the drawings are simplified examples and drawings, showing the points of novelty of the invention. In practical circuits, as would be well known in the art, ancillary components may be needed to make a functioning circuit, such as, as examples, not limitations, snubbers, EMI filters, insulation between the conductors and, perhaps, the magnetic core. Fastening and mounting means may be required. Heat sink means may be required. All of these, and other features that may be necessary to make a functional circuit are well known to ones skilled in the art, and are not points of novelty.

Figure 5:
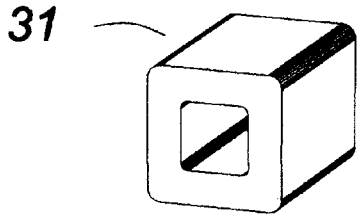
FIG. 5 show a representative transformer core, which may be used in modules of this invention.
Figure 6:
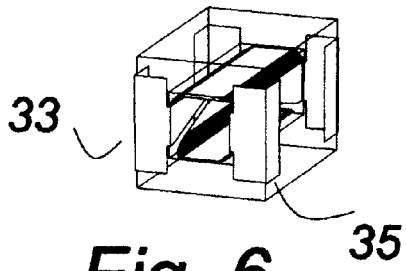
FIG. 6 shows foil secondary windings which would be suitable for the core of FIG. 5.
Figure 7:
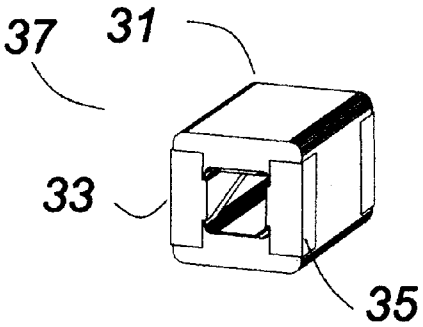
FIG. 7 shows the windings of FIG. 6 installed in the core of FIG. 5.

FIGS. 5 through 7 show a transformer core and winding sub-assembly 37 that may be used in this invention. The sub-assemblies 37 are commercially available from Flat Transformer Technology Corporation, Costa Mesa, Calif., U.S.A. A transformer core 31 has a square cross section and a square hole. The square shape has no significant effect on the magnetic properties, but it has a number of advantages for assembly and heat sinking. It is gap-less, and has a high cross sectional area and short magnetic length, for high inductance.

FIGS. 6 and 7 shows that two foil windings 33 and 35 may be installed in the magnetic core 31. The core is shown in phantom in FIG. 6, as if it were transparent, so the internal configuration can be seen. The windings 33 and 35 are preferably foil windings bonded to the inside diameter of the magnetic core 31. In the example, the windings are half helices, so that the terminations of a given winding 33 or 35 are on opposite corners of the core 31. This arrangement has no significant effect on the magnetic properties, and is used to facilitate the external connections to the windings 33 and 35.

In the examples shown, the transformer core and winding sub-assemblies 37 are used in pairs.

Figure 8:
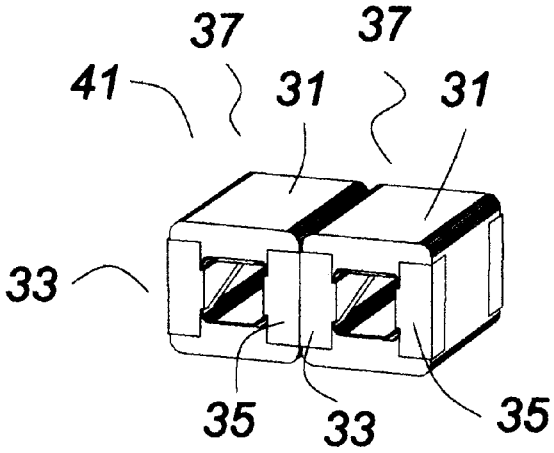
FIG. 8 shows two of the cores of FIG. 7 in a side by side arrangement with their windings connected.

In FIG. 8, a half-turn transformer sub-assembly 41 comprises two core and winding sub-assemblies 37 side by side with the windings 33, 35, 33 and 35 connected. One connection is visible on the exposed face of the sub-assembly 41, and the other is on the opposite face. The holes through the assembly are parallel and are open to allow the later installation of a primary winding.

Figure 9:
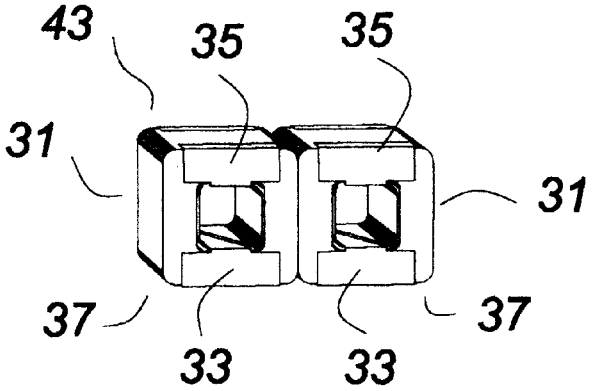
FIG. 9 shows two of the cores of FIG. 7, rotated 90 degrees, in a side by side arrangement with their windings not connected.

In FIG. 9, a half-turn transformer sub-assembly 43 comprises two core and winding sub-assemblies 37 side by side, but turned 90 degrees (as compared to the sub-assembly 41 of FIG. 8) so that the terminations of the windings 33, 35, 33 and 35 are on the top and bottom.

In performance and magnetic characteristics, the assemblies are equivalent, and the choice is made considering the layout of the ancillary external components.

Figure 10:
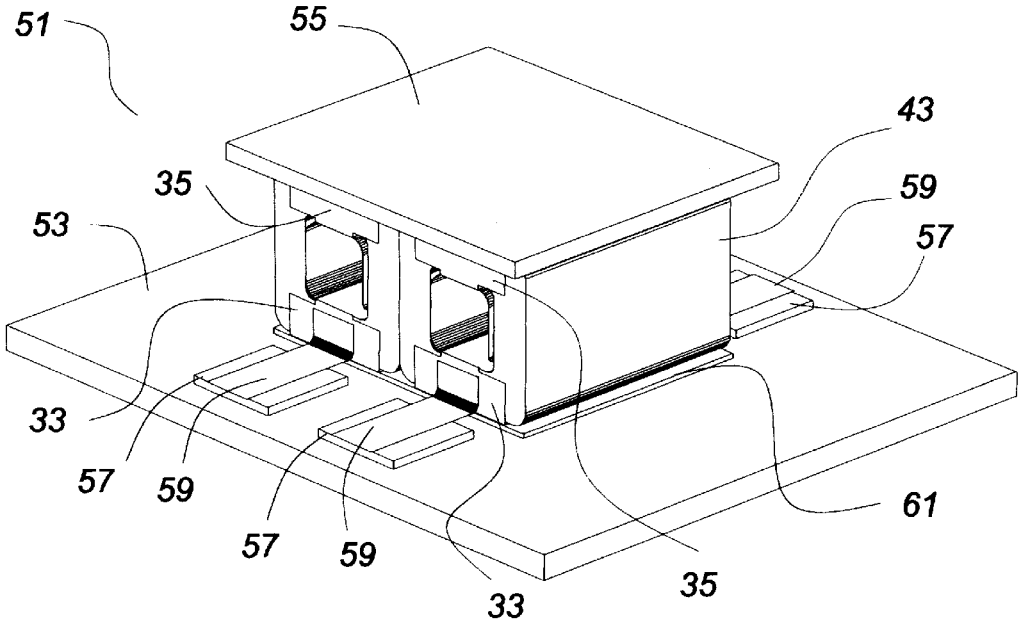
FIG. 10 shows a half turn transformer and rectifier module using the core arrangement of FIG. 9. Rectifier die are mounted on the base plate.

FIG. 10 shows a transformer and rectifier module 51 having a half turn secondary winding. The magnetic cores and windings are the sub-assembly 43 of FIG. 9.

All of the windings exiting the cores on the top are connected directly to a top plate 55. On the side that shows, windings 35 and 35 connect to the top plate 55. On the hidden sides, since they are half helices, the windings 33 and 33 connect to the top plate 55. In comparison with the arrangement of FIG. 2, the top plate corresponds to the grounds 25 and 27, and the windings 33 and 33 correspond to the "Y" legs of one of the windings 7 and 9, with the windings 35 and 35 corresponding to the legs of the other "Y" winding.

The other end of each winding 33, 33, 35 and 35 (with respect to its connection to the top plate 55) is connected through four connection tabs 59—59 (only three of which are visible) to the anodes of four rectifier die 57—57 (only three of which are visible). The cathodes of the four rectifier die 57—57 are bonded to the bottom plate 53, so the bottom plate 53 then serves as a power plane for the positive output as well as a mounting plate for he whole assembly and a heat sink for the rectifiers 57—57. (It would be negative if the rectifiers are reversed, an option) An insulator 61 keeps the transformer windings 33, 33, 35 and 35 from shorting to the bottom plate 53.

The through holes through the transformer and rectifier assembly 51 are to receive the primary winding. It is contemplated that in many instances the assembly 51 may be furnished without a winding, so the user can later wind whatever winding suits his application. In other instances, the primary winding may be installed at the factory or by a sub-contractor, so the assembly as a whole is complete, and can be tested as an operating transformer and rectifier unit.

A variation on the assembly of FIG. 10 would have the rectifiers installed in recesses under the transformer cores, but connected in the same way. This would provide a more compact final assembly, and would allow multiple units to be used side by side with their through holes aligned. The cores would hide the rectifier die, but would also protect them.

Figure 11:
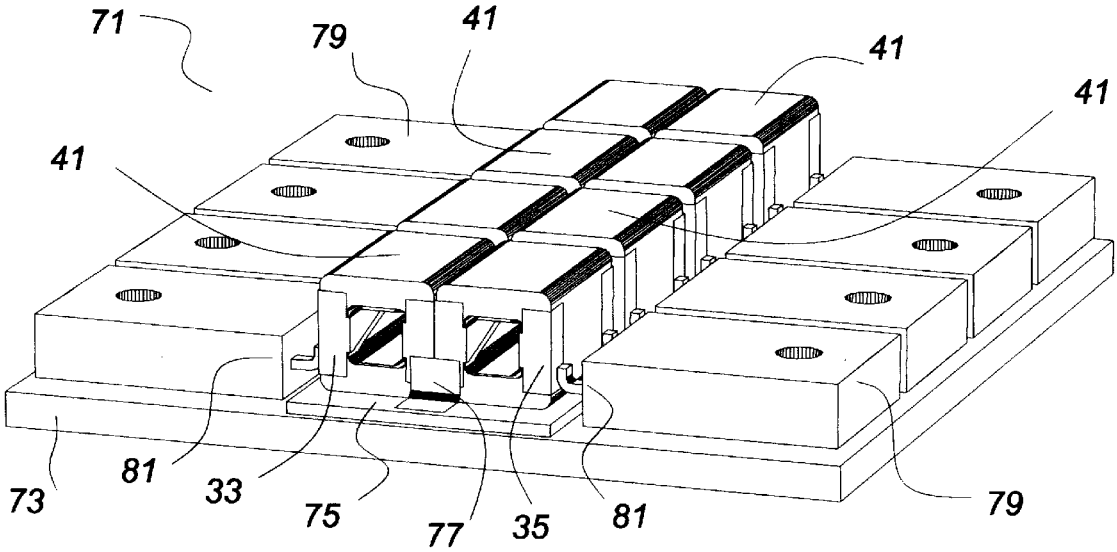
FIG. 11 shows four half turn transformer and rectifier modules using the core arrangement of FIG. 8, arranged in a matrix transformer arrangement. Eight industry standard dual rectifier packages connect directly to the terminations on the sides of the modules. With four modules having half turn secondaries, the overall secondary has one eighth equivalent turns.

FIG. 11 shows a transformer and rectifier assembly 71 comprising four modules 41—41, which are the module sub-assemblies 41 of FIG. 8. In all instances (eight places), a tab 77 connects the common connection of the windings 33 and 35 to a ground bus bar 75, which is equivalent schematically to the ground connections 25 and 27 in FIG. 2.

Eight industry standard dual rectifiers 79—79 have their anode connections 81—81 to the ends of the windings 33 and 35 on the outside surfaces of the sub-assemblies 41—41. The common cathode connections of the rectifiers 79—79 are usually common to their mounting surfaces to the bottom plate 73. Thus the bottom plate 73 is the positive power output plane as well as the mounting and heat sinking plate for the assembly 71 as a whole. As would be understood by one skilled in the art of power converters, the negative bus bar 75 must be isolated from the bottom plate 75, as by an insulating film or the like. If reversed polarity rectifiers are used, the polarity of the output busses would be reversed. Some power rectifier packages have insulated mounting heat sink surfaces. The use of these is not preferred, as direct connection to the power plane reduces impedances, but, if necessary, connection through a lead is possible, as would be understood by one skilled in the art.

Anyone familiar with matrix transformers will recognize that the assembly 71 of FIG. 11 has many similarities to the matrix transformer. In a matrix transformer, the equivalent turns ratio is the number of primary turns times the number of modules to one. A similar relationship holds here, except that these are half-turn modules. Therefore the equivalent turns ration will be the number of primary turns times the number of modules to one half, or, two times the number of primary turns times the number of modules to one. Half the number of primary turns are needed for a given turns ratio, and the current will be double.

As compared to the assembly 51 of FIG. 10, the assembly 71 of FIG. 11 will have higher leakage inductance (on a per module basis) because the leakage inductance in the rectifier packages is significant. Yet both assemblies are arranges so that the leakage inductance in the external circuits is minimized by making the connections as short and direct as possible.

I claim:

1. A transformer module, having a half-turn secondary winding, comprising:

a transformer core having first and second through holes, in parallel, passing through the transformer core from a first side to a second side, a half-turn secondary winding comprising first and second "Y" windings, the first and second "Y" windings each comprising a first "Y" leg, a second "Y" leg and a common connection connecting the first "Y" leg to the second "Y" leg, the first "Y" winding being installed in the transformer core from the first side with the first and second "Y" legs of the first "Y" winding passing respectively through the first and second through holes of the transformer core, and with the common connection of the first "Y" winding straddling the first and second through holes of the transformer core on the first side of the transformer core, the first "Y" winding being installed in the transformer core from the first side with the first and second "Y" legs of the second "Y" winding passing respectively through the second and first through holes of the transformer core, and with the common connection of the second "Y" winding straddling the first and second through holes of the transformer core on the second side of the transformer core, first and second terminations terminating respectively the first and second "Y" legs of the first "Y" winding on the second side of the transformer core, third and fourth terminations terminating respectively the first and second "Y" legs of the second "Y" winding on the first side of the transformer core, and a fifth termination terminating both the common termination of the first "Y" winding and the common termination of the second "Y" winding.

2. The transformer module of claim 1 further comprising first, second, third and fourth rectifiers with their respective anodes connected respectively to the first, second, third and fourth terminations, and with their respective cathodes connected in parallel to a sixth termination.

3. The transformer module of claim 1 further comprising first, second, third and fourth rectifiers with their respective cathodes connected respectively to the first, second, third and fourth terminations, and with their respective anodes connected in parallel to a sixth termination.

4. The transformer module of claim 1 wherein the fifth termination is at least one of a ground plane plate and a ground plane bus bar, common to both the common termination of the first "Y" winding and the common termination of the second "Y" winding.

5. The transformer module of claim 2 wherein the sixth termination is a common power plane plate and heat sink for the first, second, third and fourth rectifiers.

6. The transformer module of claim 2 wherein the sixth termination is a common power plane plate and heat sink for the first, second, third and fourth rectifiers.

7. The transformer module of claim 1 wherein the transformer core comprises two magnetic cores, side by side, each with a through hole, with their through holes parallel.

* * * * *